United States Patent [19]

Sasaki et al.

[11] 4,158,380

[45] Jun. 19, 1979

[54] CONTINUOUSLY CASTING MACHINE

[75] Inventors: Kantaro Sasaki, Ashiya; Sumio Kobayashi, Yamatokoriyama; Yasuo Sugitani, Takarazuka; Susumu Ishimura, Hirakata, all of Japan

[73] Assignee: Sumitomo Metal Industries Limited, Osaka, Japan

[21] Appl. No.: 881,411

[22] Filed: Feb. 27, 1978

[51] Int. Cl.[2] ..... B22D 27/02; B22D 11/00

[52] U.S. Cl. ..... 164/147; 164/250; 164/49

[58] Field of Search ..... 164/48, 49, 146, 147, 164/250; 266/233, 234

[56] References Cited

FOREIGN PATENT DOCUMENTS 47-33025 11/1972 Japan ..... 164/49
51-61438 5/1976 Japan ..... 164/147
173173 11/1960 Sweden ..... 164/49
872591 7/1961 United Kingdom ..... 164/49

*Primary Examiner*—Othell M. Simpson
*Assistant Examiner*—K. Y. Lin
*Attorney, Agent, or Firm*—Watson, Cole, Grindle & Watson

[57] ABSTRACT

A continuously casting machine is provided with structure for agitating under action of magnetic force the molten steel in a slab drawn from a mold. The agitating device comprises permanent magnet groups arranged on both surfaces of the longitudinal sides of the slab and extending from the part directly below the mold to the completely solidified part of the slab. Direct current is passed to the molten steel in the slab, thereby providing the agitating force under the mutual action of a stationary magnetic field and direct current to the molten steel.

5 Claims, 16 Drawing Figures

CONTINUOUSLY CASTING MACHINE

BACKGROUND OF THE INVENTION

1. Field of the Invention:

This invention relates to a device for agitating unsolidified molten metals in continuous casting apparatus and more particularly to a device for agitating an unsolidified molten steel in continuous casting apparatus.

2. Description of the Prior Art

A segregation zone rich in carbon, sulfur and phosphorus is likely to be generated in the center portion of a slab made by continuous casting. Such a segregation zone presents a different macroscopic structure from that of a normal zone. In some cases, there is a defect that the product made of such slab has very poor mechanical properties and a low commodity value depending on its uses.

It is known that the above mentioned center segregation can be reduced by producing many equiaxed crystals in the center portion of the slab. For example, it has been suggested to agitate the unsolidified molten metal within the slab in the course of the solidification thereof.

Among the conventional methods of agitating unsolidified molten metals, there is a method A wherein a continuously cast solidifying slab is agitated by making a rotating magnetic field or a shifting magnetic field act on it and giving a thrust to the unsolidified part of the slab in the same direction as the shifting direction of the magnetic field; and a method B wherein the cast slab is agitated by making a stationary magnetic field act on the unsolidified part within the slab, making a direct current flow to the unsolidified molten metal and giving a thrust to the unsolidified molten metal by the mutual action of this current and magnetic field.

According to the method A, an agitating device must be mounted by removing a roller of a roller apron; and the agitating device must be provided with a special rigid supporting means so as to prevent the slab from bulging due to the static pressure which is proportionally larger towards the lower part of the slab, the provision of the supporting means making the whole structure complicated. Therefore, in the method A, it is impossible to mount several agitating means by removing several rollers of the roller apron as only one agitating means can be mounted. It is further impossible to mount the agitating means at the lower part of the slab.

The method A produces a non-uniform white band so that the macroscopic structure may be impaired. In order to obtain an agitating effect with one agitating means the agitation must be strongly effected so that it may result in the clear appearance of the white band. Further, since the agitation is effected in only one direction (the direction of the width of the slab), the width of the white band is liable to fluctuate.

The method B employs U-shaped permanent magnets. Such U-shaped magnets which are impossible to mount in the continuous casting machine, particularly, adjacent the slab, because for mounting the U-shaped magnets it is necessary to remove the guide rollers so that the structure may become so complicated as that mentioned in connection with the method A, and also the same defects are present as in the method A. According to the method B the agitated flow is defined by a large loop, since the N poles and S poles of the magnets are respectively on the same side of the width direction of the slab so that a non-uniform white band is clearly present.

However, according to the present invention the N poles and S poles of the magnets are arranged alternately to be opposed to each other and therefore the agitated flow describes small loops so that a uniform white band is formed.

However, in either method, a magnetic field generating device for obtaining the magnetic field is required. For the method A, there is adopted a method wherein, as shown, for example, in Japanese Published Patent application No. 33025/1972, many electromagnetic coils are paralelly mounted and opposed to each other on one or both surfaces of a slab, and alternating currents of different phase are made to flow to the respective coils. Further, for the method B, there is used a method wherein, as shown in British Patent No. 872,591, an electromagnetic is provided directly adjacent to the surface of a slab.

In order to obtain a magnetic field sufficient to agitate an unsolidified molten metal in such a magnetic field generating device, it is necessary to bring the coil as near to the slab as possible.

However, in the general continuous casting machine, many rollers are provided to rotate in contact with a slab so as to support and guide it. As seen in the above described publication or patent, unless some of these rollers are removed, the magnetic field generating device will not be able to be mounted near the slab. However, in case some of the rollers are removed, as they are, the solidified shell of the slab in such regions will be pushed and expanded outwardly by the static pressure of the molten metal. In order to prevent it, a slab supporting device of a special structure is required and the continuous casting machine becomes very complicated.

Further, generally there is a defect that, if the inner molten steel is strongly agitated in the course of the solidification, the part solidified during the agitation becomes a negative composition segregation zone called a white band. However, such a white band can be dissolved without impairing the effect of reducing the center segregation by agitating the molten metal by reducing and dividing the strength of the agitation into several steps. However, in the conventional agitating method, as described above, the agitating device is so complicated to be difficult to mount in several steps, and therefore the production of the white band can not be prevented.

SUMMARY OF THE INVENTION

An object of the present invention is to provide an entirely new device for eliminating the defects of such conventional methods, characterized in that a strong permanent magnet is arranged in a clearance between rolls supporting a slab. A static magnetic field with a main direction perpendicular to the slab-drawing direction is made to act on molten steel in the course of solidification. A direct current with a main direction parallel with the drawing direction is made to flow on the molten steel in the part in which the magnetic field acts. The molten steel in the course of solidification is agitated by the mutual action of this static magnetic field and the direct current. In the present method, as the permanent magnet can be easily arranged in the clearance between the rolls, the arrangement of the rolls of the conventional continuously casting machine need not be changed at all. Therefore, even if the rolls are arranged in any number of steps, a multi-step agitation is very easily made and the generation of a white band accompanying the agitation as is described above is prevented.

Figure 1:
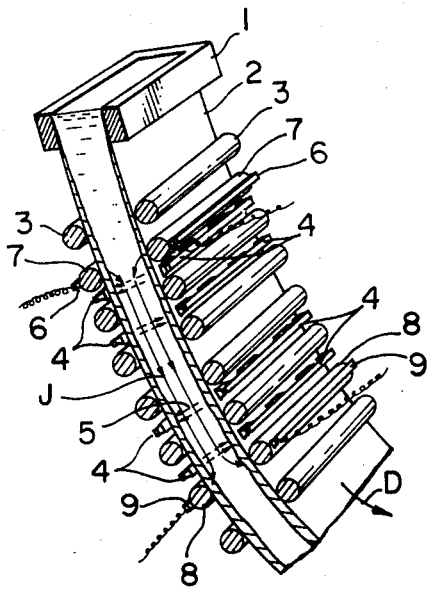
FIG. 1 is a perspective view showing an essential part of a circular arc type continuously casting machine according to the present invention.

DETAILED DESCRIPTION OF THE PREFERRED EMBODIMENTS:

In FIG. 1 showing an essential part of a circular arc type continuous casting machine, 1 is a casting mold, 2 is a slab which is to be withdrawn in the direction of an arrow D and 3 is a roller forming a roller apron. A permanent magnet group 4 is provided between the rollers in a required place of this roller group.

Figure 2A:
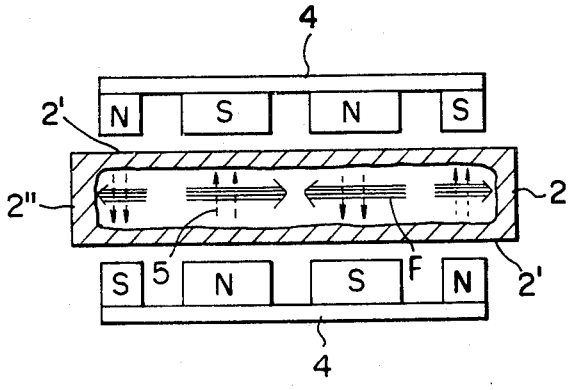
FIG. 2A is a cross-sectioned view of an embodiment of a magnet setting part.
Figure 2B:
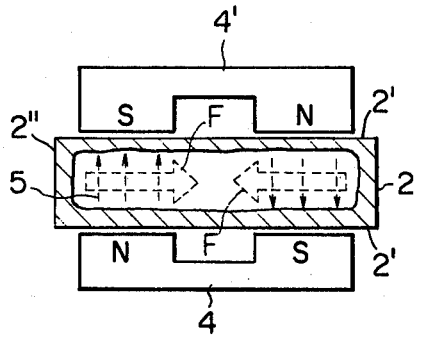
FIG. 2B is a cross-sectioned view of another embodiment of FIG. 2A.
Figure 2C:
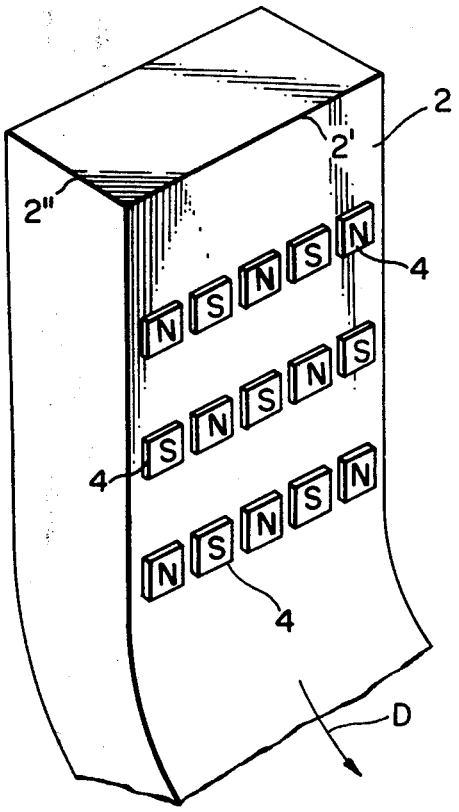
FIG. 2C is a schematic perspective view showing the most preferable arrangement of magnets.

As shown in FIGS. 2A or 2B, the magnet groups 4 consisting of four pairs of permanent magnets and two pairs of permanent magnets, respectively, are so set that their N poles and S poles are opposed, and are adjacent to long side 2' of slab 2. There is no special device provided on a short side 2" of the slab 2. The simplest one of the methods of arranging the permanent magnets 4 is shown in FIG. 2A. In this case, the agitated flow will describe a comparatively large loop as shown below and a white band caused by the agitation is likely to be generated. Therefore, in case it is particularly desired to prevent the generation of the white band, it will be necessary to arrange two or more permanent magnets in the width direction of the slab as along FIG. 2A and, as shown in FIG. 2C, to arrange the N poles and S poles of the permanent magnets 4 of the permanent magnet groups arranged on both surfaces on the long side 2' of the slab in the reverse relation to the N poles and S poles of the adjacent permanent magnet groups in the withdrawing direction of the slab on the same surface. It is also desirable to arrange a plurality of permanent magnet groups 4 to cover the entire width direction of the slab 2.

Figure 3A:
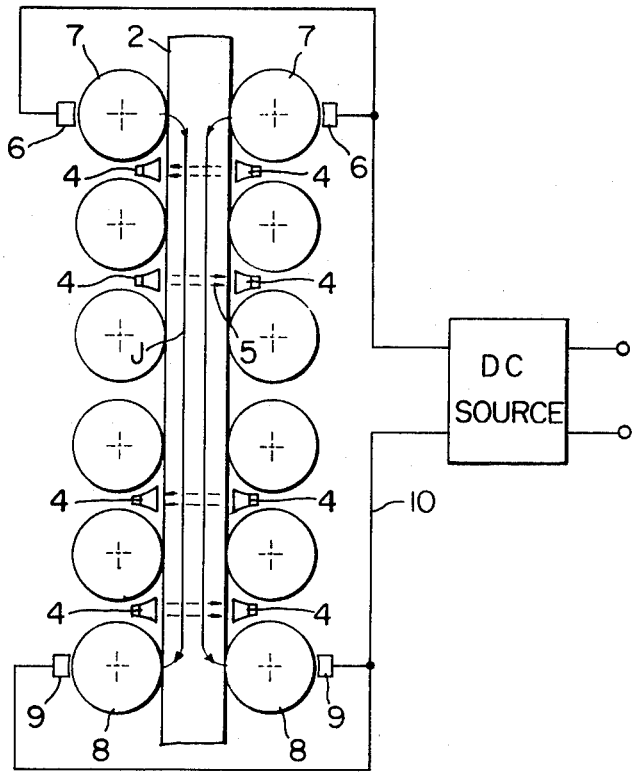
FIGS. 3A to C are side views of respective embodiments showing current paths in the slabs.
Figure 7:
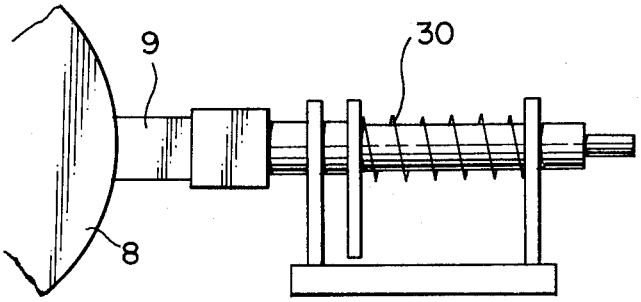
FIG. 7 is a magnified side view showing the relationship a roller and brush.

Rollers 7 above the uppermost magnet of the premanent magnet group arranged as mentioned above, and rollers 8 below the lowermost magnet of the group are provided respectively with brushes 6 and 9 connected to a direct current source circuit 10 so that, in case a current is passed as shown in FIG. 3A, it may flow to the rollers 8 and brushes 9 through the unsolidified molten metal of the slab 2 from the brushes 6 and rollers 7. The details of this part are shown in FIG. 7. A spring 30 is provided in the rear of the brush 9 to adjust the pressing force in contact with the roller. In this direct current circuit, in order to prevent the current from leaking from other rollers, the respective rollers are insulated from the continuous casting machine body in the bearing parts.

Figure 3B:
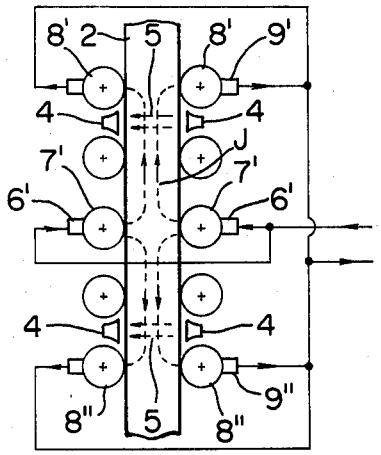
Figure 3C:
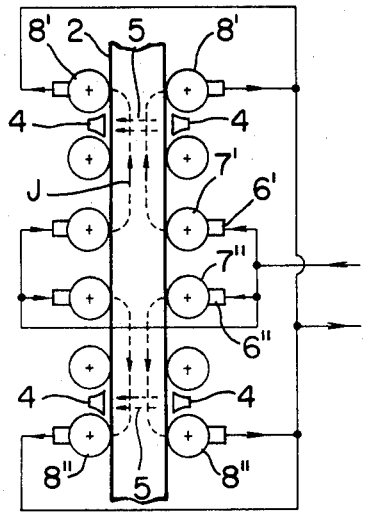

Not only is there a current passing circuit as in the embodiment shown in FIG. 3A, but also such embodiment as in FIGS. 3B and 3C are possible.

In these embodiments, if only the rolls between rolls 8' and 8" leading out the current in two upper and lower places are insulated from the continuous casting machine, even if other rolls are not insulated, the current led into the slab from a roll 7' or 7" passes through the part in which the magnetic field acts and the insulated parts of the rolls may be few in number.

The above mentioned permanent magnet has a residual magnetic flux density Br of 5 to 10 KG and a coercive force Hc of 5 to 10 kOe. However, a permanent magnet having a maximum energy product (BrHc) max is adapted. A rare earth metal cobalt magnet having such composition as $YCo_5$, $CeCo_5$, $PrCo_5$, $SmCo_5$ or $SmPrCo_5$ is optimum.

Figure 8D:
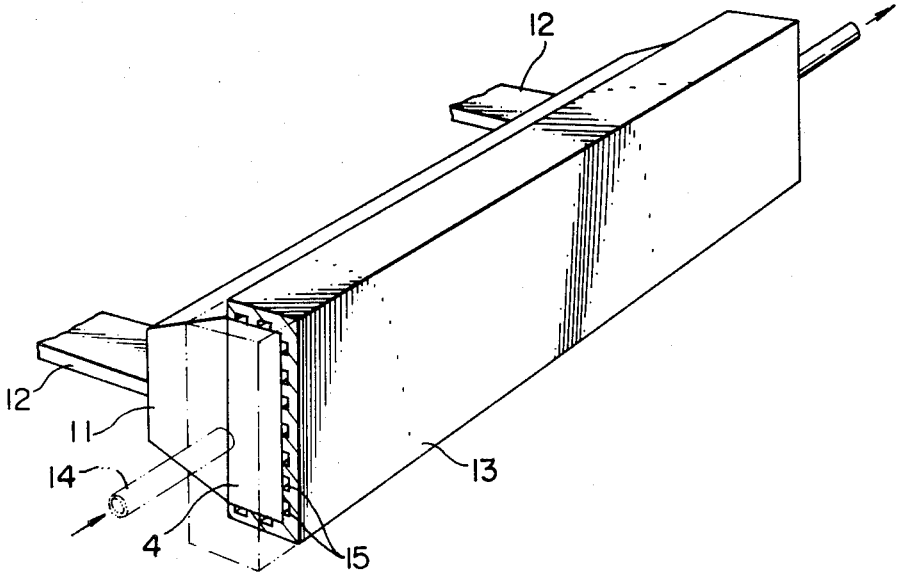
FIGS. 8A to D are views showing respective embodiments of the shapes and arrangements of magnets.
Figure 8A:
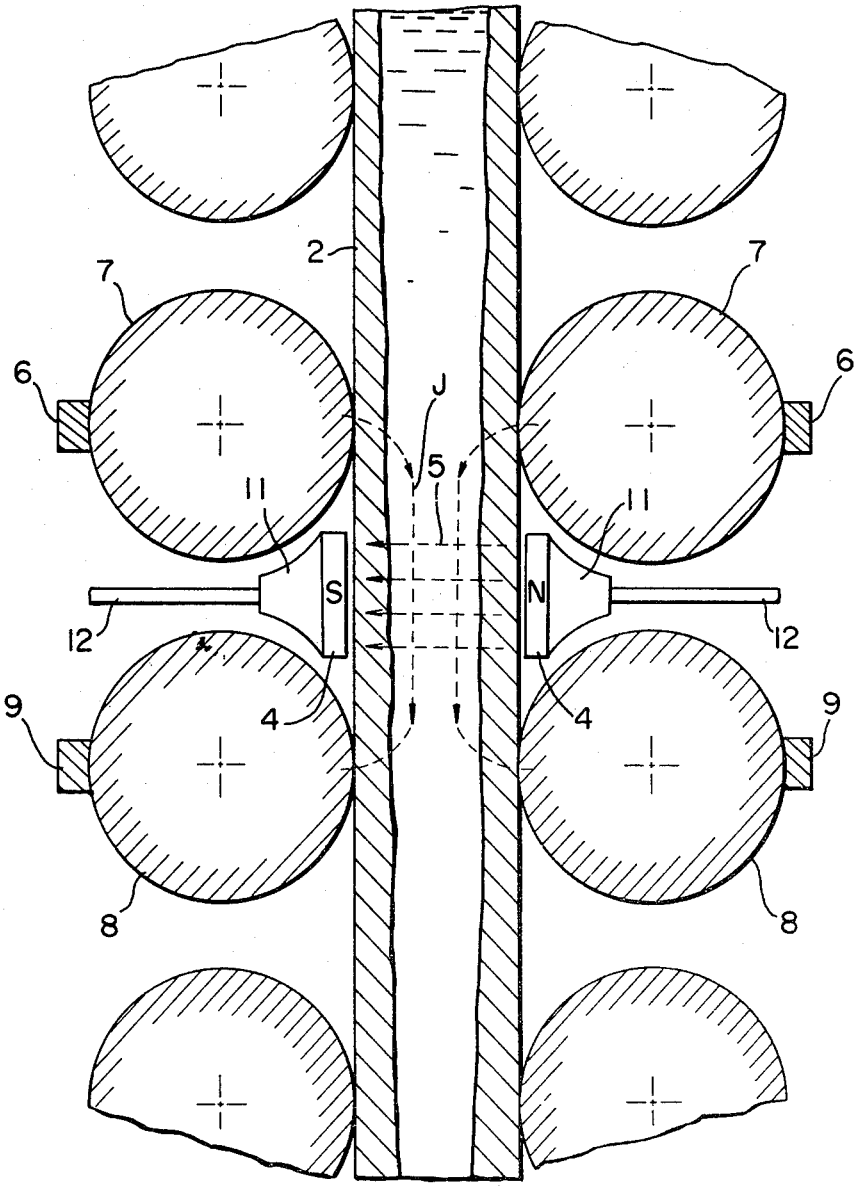
Figure 8B:
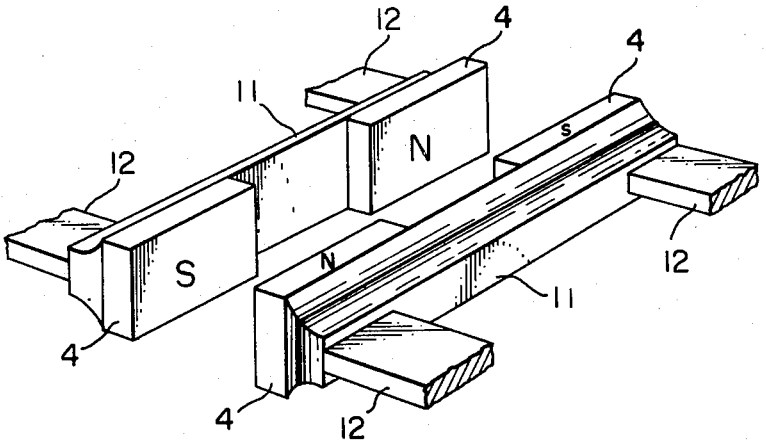
Figure 8C:
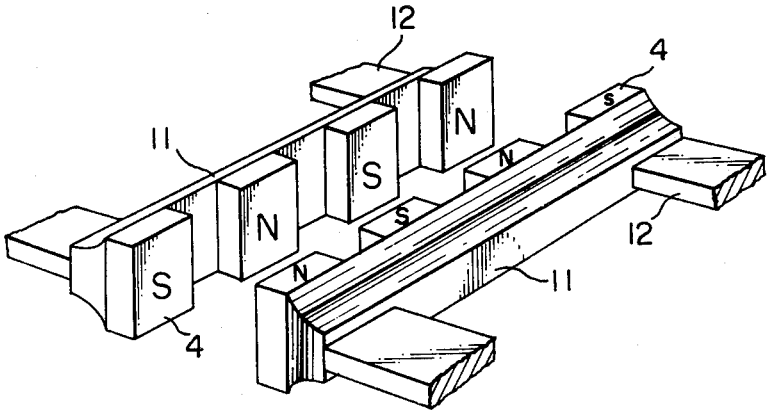

As shown in FIGS. 8A to D, the magnet is of such shape as can be contained in the clearance between the rolls and two or more permanent magnets 4 may be fixed at proper intervals inside a yoke 11 of a length substantially equal to the width of the slab 2. The yoke 11 is provided on the back surface thereof with supporting arms 12 to be fixed and supported at proper parts of the continuous casting machine. Also, as shown in FIG. 8D, in order to prevent damage by convection heat from the slab, the permanent magnet is covered with a covering member 13 made of such nonmagnetic substance as 18-8 stainless steel, having cooling water passages 14 and 15 and capable of being forcibly cooled.

Figure 9:
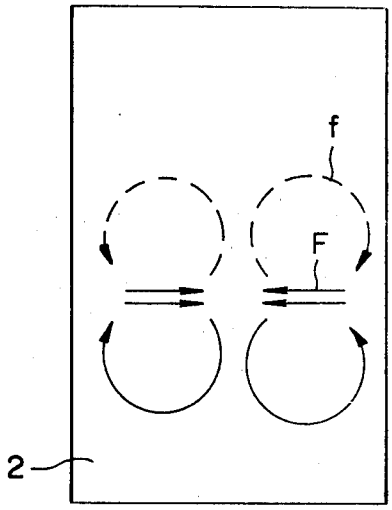
FIG. 9 is a fundamental explanatory plan view showing the conventional state of an unsolidified molten metal within a slab.
Figure 4:
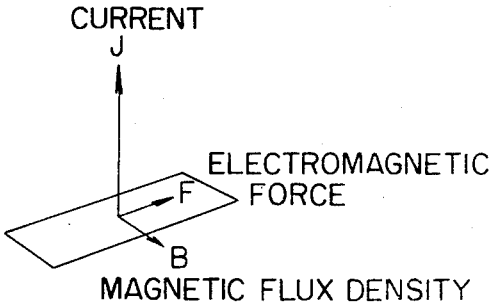
FIG. 4 is an explanatory view showing the relationship of magnetic flux density, direct current and electromagnetic force.
Figure 5:
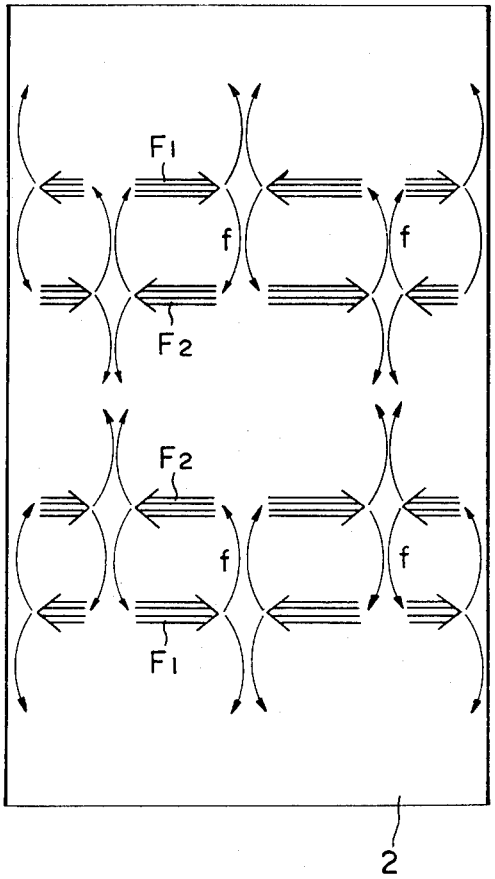
FIG. 5 is an explanatory plan view showing the convection state of an unsolidified molten metal within a slab.

If continuously cast by this device, a magnetic field 5 whose main direction is perpendicular to the drawing direction due to the permanent magnets 4 opposed to each other as shown in FIG. 2A will act on the slab 2 in the course of solidification in the roller apron part after being drawn out of the casting mold 1. However, by passing a current to the above mentioned direct current circuit, a direct current will act within the slab whose main direction is the same as the slab drawing direction. By the mutual action with the above mentioned magnetic field 5, as shown in FIG. 4, an electromagnetic force F in the width direction of the slab perpendicular respectively to the direct current J and the magnetic flux density B of the magnetic field 5 will act on the unsolidified molten metal within the slab. Therefore, for example, in case the magnets are arranged as in FIG. 2B, an electromagnetic force represented by F will act on the unsolidified molten steel within the slab, and a fluidifying agitation as in FIG. 9 will occur, such that equiaxed crystals will be formed within the slab and the center segregation will be reduced. In the case of FIG. 9, as described above, in order to form sufficient equiaxed crystals with only the flow of two comparatively large loops, it will be necessary to make the flow considerably severe. In some cases, depending on the kind of steel, a white band will be generated. Therefore, in case it is particularly desired to avoid the generation of a white band, if many magnets are arranged in the width direction as in FIG. 2A, such magnets are arranged in multi-steps in the drawing lengthwise direction as in FIG. 1. The electromagnetic forces $F_1$ and $F_2$ of two sets of permanent magnets arranged above and below are so formed as to act in directions reverse to each other as shown in FIG. 5. Thereby, a partly rotating thrust f will be producted between the sets of permanent magnets. By this thrust f, the unsolidified molten metal may form many small convective loops and may be totally agitated.

EXAMPLE

Three charges of a low carbon aluminum-silicon killed steel (of a composition of 0.16% carbon, 0.3% silicon, 1.45% manganese, 0.018% phosphorus and 0.013% sulfur, (the balance being iron) are continuously refined in a 160-ton converter and continuously cast in a circular are type slab of two strands under the conditions of a teeming temperature of 1540° C. and casting speed of 0.8m/min to make 240 tons of each strand of slabs having cross-sectional dimensions of 190 mm×1600 mm.

In this case, the slab of the first strand was solidified while being agitated in the unsolidified part by a DC voltage of 20V and a DC current of 5500 A flow in the drawing direction by arranging permanent magnets ($SmCo_5$) having a magnetic flux density of 1KG in the middle in the thickness direction of the slab in the state shown in FIGS. 1 to 3 in four places separated by 450, 475, 530 and 560 cm from the upper surface of the casting mold and setting current passing brushes on the 10th and 15th rollers from above roller apron in accordance with the present invention. The other slab of the second strand was solidified in the ordinary manner without being agitated.

Figure 6:
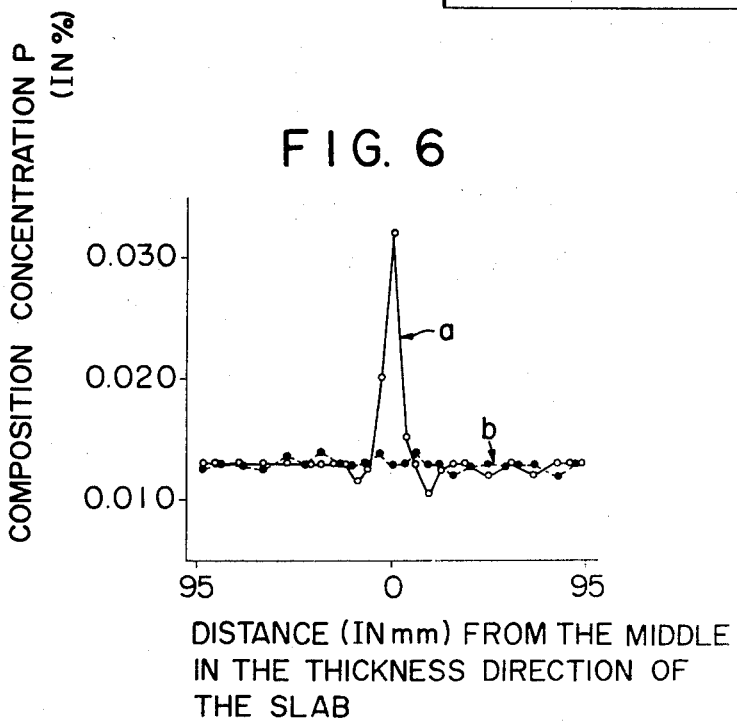
FIG. 6 is a graph showing a phosphorus segregation state of a slab.

Test pieces were cut out of the parts 20, 50 and 80 m after the beginning of the teeming, the sulfur prints of the cross-sectional areas and the composition distributions in the thickness directions of the slabs were investigated as well as the segregation states in the center portions of the slabs. The results are shown in FIG. 6 which shows the distribution of phosphorous in the thickness directions of the slabs. The curve b is a distribution curve of the sample of the first strand slab in accordance with the present invention. The curve a is a distribution curve of the sample of the second strand slab which was not agitated. As evident from this graph, whereas a large phosphorus segregation was present in the center portion of the non agitated, slab whereas substantially no segregation was present as a whole when agitated by using the present invention.

What we claim is:

1. In a continuous casting machine, apparatus for stirring molten metal in the slab, comprising at least two permanent magnet groups mounted in spaced opposed relationship to the surfaces of the opposite long sides of the slab and extending from a portion below a casting mold of the casting machine to a completely solidified part of the slab, each of said permanent magnet groups including one or more permanent magnets arranged in the width direction of the slab, the S poles and N poles of the permanent magnets being paired and opposed to the N and S poles of the opposed permanent magnet group through the slab, and brushes for contacting with supporting rolls of the casting machine to provide a flow of direct current in the molten steel within the slab in the slab-drawing direction.

2. The apparatus according to claim 1 wherein there are at least two of said permanent magnet groups on each side of said slab and the S poles and N poles of the permanent magnets forming the permanent magnet groups arranged on each surface of the long sides of the slab are reverse respectively to those of the permanent magnets of the adjacent permanent magnet groups in the withdrawing direction of the slab on the same surface side of the slab.

3. The apparatus according to claim 1 or 2 wherein the continuous casting machine includes guide rollers and the permanent magnet groups are arranged in space defined by said guide rollers and the slab, said guide rollers being arranged at intervals along said slab.

4. The apparatus according to claim 3 wherein successively positioned brushes for contacting with supporting rolls of the casting machine are alternately connected to opposite poles of a D.C. source to provide respective alternately oppositely directed direct current in the slab-drawing direction and opposite to the slab-drawing direction in respective portion of the slab between said successively positioned brushes.

5. The apparatus according to claim 4 further comprising at least one yoke on each side of said slab for mounting said permanent magnet groups and said yoke including means for cooling said yoke and said permanent magnet groups.

* * * * *